United States Patent [19]

Koeppen

[11] 3,994,087

[45] Nov. 30, 1976

[54] PICTURE FRAME WITH PERMANENTLY SECURED MAT BOARD

[76] Inventor: Peter Bryant Koeppen, Rte. 3, Box 99, Annapolis, Md. 21403

[22] Filed: Jan. 20, 1976

[21] Appl. No.: 650,868

[52] U.S. Cl. ..... 40/152

[51] Int. Cl.[2] ..... G09F 1/12

[58] Field of Search ..... 40/152, 152.1, 154, 40/155, 156, 158, 159

[56] References Cited

UNITED STATES PATENTS 2,521,603 9/1950 Prew ..... 40/152

3,060,606 10/1962 Peach ..... 40/154

*Primary Examiner*—Louis G. Mancene

*Assistant Examiner*—John H. Wolff

[57] ABSTRACT

A picture and poster frame manufactured from vinyl covered particle board, mitre cut and grooved in a strip or strips and placed around a pre-cut mat board to form a complete frame with a permanent mat. Pictures and posters are displayed by affixing them to the underside of the permanent mat.

1 Claim, 4 Drawing Figures

PICTURE FRAME WITH PERMANENTLY SECURED MAT BOARD

SUMMARY OF THE INVENTION;

The object of the invention is to produce a strong, light weight, attractive, and inexpensive pre-matted picture and poster frame.

The frame is made from lengths of particle board that have been covered with any variety of colored vinyl material. The covered particle board is mitre cut at each corner, without cutting through the covering material, and cut with two length-wise grooves. The upper groove is cut to accept a mat board, and the lower groove as a retaining slot for a nail or screw head for hanging the frame flush to a wall.

The strip or strips of covered particle board are placed around a pre-cut mat board to form a complete frame with a permanent mat on which any graphic may be affixed by adhesive tape or glue.

BRIEF DESCRIPTION OF DRAWING VIEWS;

FIG. 1 End view of a section of vinyl covered, mitre cut, and grooved particle board.

FIG. 2 Top view of a section of vinyl covered particle board, showing mitre cuts for corners.

FIG. 3 Perspective view of assembled frame with end section cut away to show assembly.

FIG. 4 Perspective view of complete frame with permanent mat board.

DETAILED DESCRIPTION;

Figure 1:
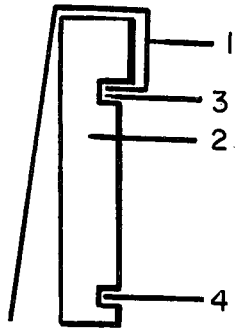

As shown in FIG. 1 the vinyl material, 1, is laminated to all outside surfaces and extending into the mat groove, 3, of the particle board, 2. Groove 4, is the retaining slot.

Figure 2:
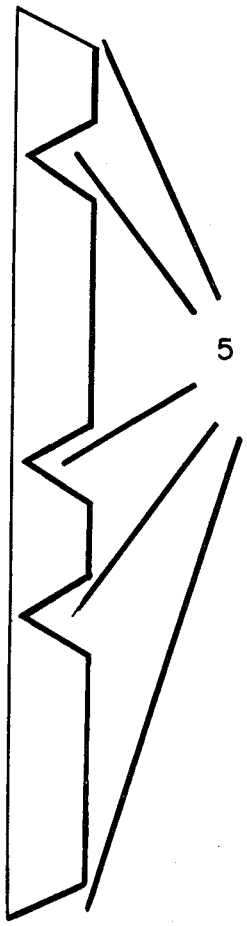

The section of vinyl covered, and grooved particle board is mitre cut, FIG. 2, indicated by numeral 5, without cutting through the covering, for each of four corners.

Figure 3:
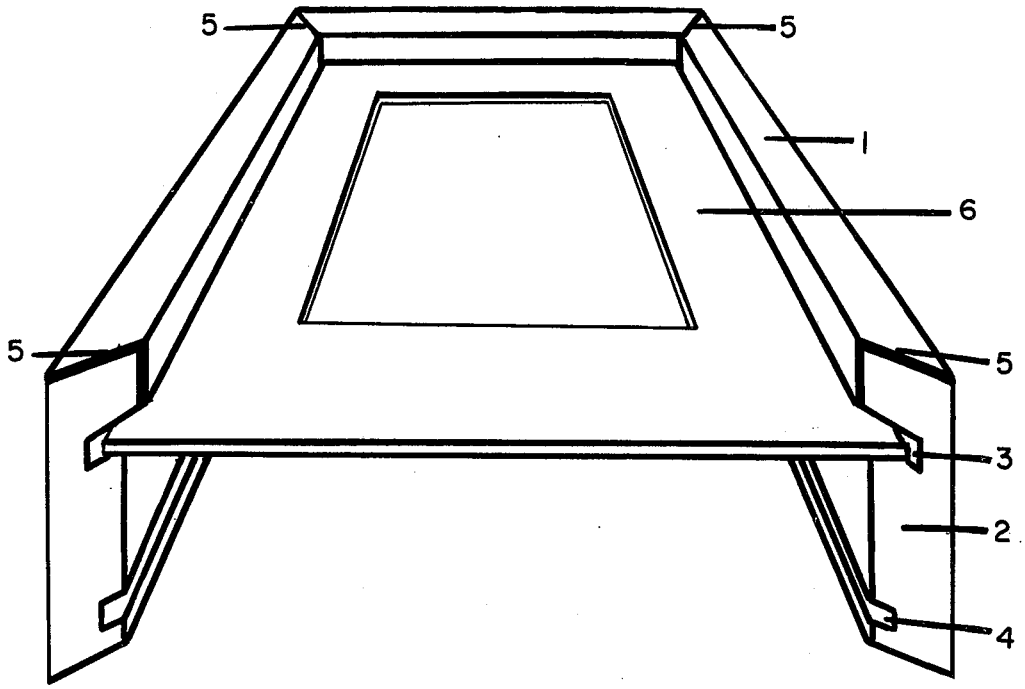

The cut and grooved strip is placed around a pre-cut mat board, FIG. 3, numeral 6, and glue is placed in each mitre cut, 5, and in the mat board groove, 3.

Figure 4:
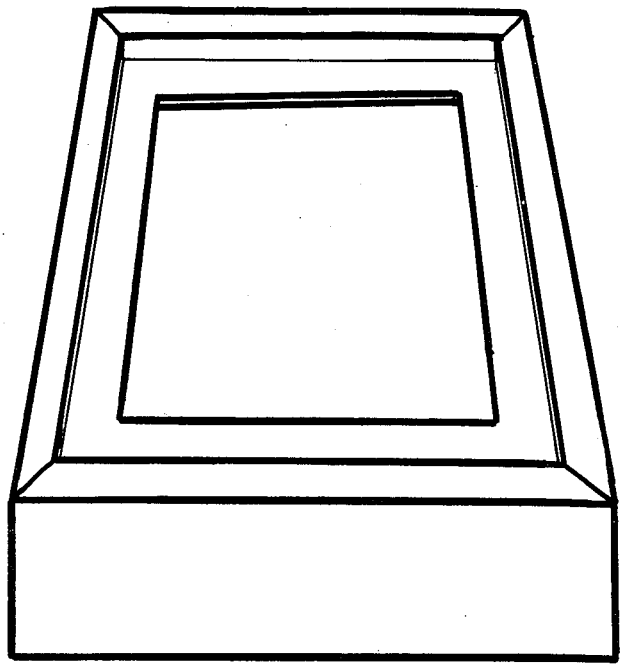

As shown in FIG. 4, the completed frame, made from lightweight material, is securely held together by the glue in each mitre cut, 5, and the glue adhearence in the mat board groove, 3, to the mat board, 6, thus producing a strong, lightweight, attractive, and inexpensive pre-matted picture and poster frame.

Graphics may be displayed in the frame by affixing them to the underside of the mat board, 6, with adhesive tape or glue. The frame is hung with all sides flush to the wall by placing the retaining slot groove, 4, over the head of a nail or screw that is embedded in a flat surface. Size and width of frame is variable as desired at time of production.

I claim:

1. The combination of a picture frame and mat as a unitary, composite structure, wherein;

1. the picture frame comprises an enclosed, hollow, vinyl coated, particle board substrate, which has at least one uniformly deep and wide groove along the internal periphery thereof, and

2. at least one apertured mat permanently affixed within the periphery of said at least one groove, and coextensive therewith, so that the composite frame and board permit for easy attachment of a display article subajacent said permanently framed board.

* * * * *